US010549947B2

(12) United States Patent
Sonnenmoser et al.

(10) Patent No.: US 10,549,947 B2
(45) Date of Patent: Feb. 4, 2020

(54) METHOD AND APPARATUS FOR DETERMINING THE POSITION OF AN ELEVATOR CAR

(71) Applicant: Inventio AG, Hergiswil (CH)

(72) Inventors: Astrid Sonnenmoser, Hochdorf (CH); Christian Studer, Kriens (CH); Klaus Zahn, Villars-sur-Glane (CH); André Rüegg, Kloten (CH); Johannes Gassner, Zürich (CH)

(73) Assignee: INVENTIO AG, Hergiswil NW (CH)

( * ) Notice: Subject to any disclaimer, the term of this patent is extended or adjusted under 35 U.S.C. 154(b) by 371 days.

(21) Appl. No.: 15/532,562

(22) PCT Filed: Dec. 2, 2015

(86) PCT No.: PCT/EP2015/078385
§ 371 (c)(1),
(2) Date: Jun. 2, 2017

(87) PCT Pub. No.: WO2016/087528
PCT Pub. Date: Jun. 9, 2016

(65) Prior Publication Data

US 2017/0349399 A1 Dec. 7, 2017

(30) Foreign Application Priority Data

Dec. 2, 2014 (EP) ..... 14195971

(51) Int. Cl.
*B66B 1/24* (2006.01)
*B66B 3/02* (2006.01)
(Continued)

(52) U.S. Cl.
CPC ..... *B66B 1/3492* (2013.01); *B66B 1/3415* (2013.01); *B66B 5/0031* (2013.01)

(58) Field of Classification Search
CPC ..... G01P 15/00; G01P 1/023; G01P 1/026; G01P 7/00; G01P 21/00; H04N 5/232;
(Continued)

(56) References Cited

U.S. PATENT DOCUMENTS 3,891,064 A * 6/1975 Clark ..... B66B 1/30 187/295
5,485,897 A * 1/1996 Matsumoto ..... B66B 3/008 187/395

(Continued)

FOREIGN PATENT DOCUMENTS

EP 1232988 A1 8/2002
JP 2009220904 A 10/2009

*Primary Examiner* — Marlon T Fletcher
(74) *Attorney, Agent, or Firm* — William J. Clemens; Shumaker, Loop & Kendrick, LLP

(57) ABSTRACT

A method and a system for determining the position of an elevator car of an elevator system, which car is arranged for travel in an elevator hoistway, includes equipping the elevator car with an acceleration sensor that registers acceleration data in a computing unit, calculation by the computing unit of the current position and/or of the velocity of the elevator car, and equipping the elevator system with an image-recording unit, which unit records recorded images of the elevator hoistway. The computing unit compares the recorded images with current mapping images of the elevator hoistway to determine an image-based current position of the elevator car. Finally, the computing unit undertakes a recalibration of the current position using the image-based current position.

13 Claims, 6 Drawing Sheets

(51) Int. Cl.
*B66B 1/34* (2006.01)
*B66B 5/00* (2006.01)

(58) Field of Classification Search
CPC ..... H04N 21/4223; H04N 13/327; H04N 5/23258; H04N 1/00702; H04N 2201/3253; H04N 2201/3273; H04N 7/188; H04N 21/442; H04N 5/2258; G06T 7/20; G06T 7/70; G06T 7/292; B66B 5/0012; B66B 3/02; B66B 1/3492
See application file for complete search history.

(56) References Cited

U.S. PATENT DOCUMENTS

2006/0243537 A1* 11/2006 Finn ..... B66B 1/3492 187/394
2009/0288920 A1* 11/2009 Kattainen ..... B66B 5/04 187/287
2010/0219023 A1* 9/2010 Valjus ..... B66B 5/04 187/373
2012/0193169 A1* 8/2012 Mizon ..... B66B 1/00 187/247
2017/0349399 A1* 12/2017 Sonnenmoser ..... B66B 1/3492

* cited by examiner

METHOD AND APPARATUS FOR DETERMINING THE POSITION OF AN ELEVATOR CAR

FIELD

The invention relates to a method and a system for determining the position of an elevator car of an elevator system, which is arranged capable of travel in an elevator hoistway.

BACKGROUND

Known from the prior art, for example from EP 1 232 988 A1, is the provision of elevator systems with a camera, which is fastened to the elevator car and used to record images of the elevator hoistway and to derive from the images items of information about a position of the elevator car. Therein, hoistway components are set as markers, of which images are recorded by the camera and processed by a computer which is connected thereto.

Disadvantageous therein is that, in order to assign the hoistway components to an absolute position of the elevator car, a learning travel is necessary. Also with such a system, determination of an absolute position is associated with a high computing effort.

SUMMARY

It is therefore the object of the invention to specify a method and a system of the type stated at the outset which avoid the disadvantages of the prior art and, in particular, enable a reliable determination of the position of the elevator car. The system according to the invention should also be inexpensive to manufacture and to operate.

The method according to the invention for determining the position of an elevator car of an elevator system which is arranged in traveling manner in an elevator hoistway, wherein the elevator car is equipped with an acceleration sensor, comprises the following steps:

In a first step, registration takes place by a computer unit of the acceleration data from the acceleration sensor. This is followed by a calculation by the computer unit of the current position and/or velocity of the elevator car, based on a starting position and the recorded acceleration data. The position and/or velocity of the elevator car is thus determined as with an inertial navigation system. It is, however, evident that, on account of the characteristics of such a system, delays and faults can occur, which impair the reliability of the position determination. So, for example, vibrations of the elevator car cannot be definitively assigned by the acceleration sensor to a movement or a fault, so that, as a result, the calculated position will deviate from the true position. This is referred to as "drifting" of the calculated position from the true position of the elevator car.

Advantageously, the acceleration sensor is embodied as a three-axis sensor. Other sensor embodiments are nonetheless also conceivable. It is, however, important that the accelerations that occur in the direction of travel of the elevator car can be registered.

According to the invention, the elevator system is fitted with an image-recording unit. The image-recording unit is fastened to the elevator car and arranged movably together with the elevator car.

To solve the problem according to the invention, to determine an image-based current position, the computer unit compares the images that have been recorded with mapping images of the elevator hoistway. Further, the computer unit performs a recalibration of the current position by making use of the image-based current position. Thereby, through the comparison of the images that have been recorded with the mapping images, a second possibility of position-determination, and thereby a redundancy of the method according to the invention, is created.

"Mapping images" are to be understood as images which, in their totality, form a map of the elevator hoistway. The mapping images are preferably recorded during a learning travel, when commissioning the elevator, and assigned definitively to a position of the elevator car in the elevator hoistway in such manner that subsequent determination of the image-based position is possible. For this purpose, the mapping images, along with the assigned position values, are saved in a database.

The determination of the current position thus takes place initially by means of the calculated current position from the acceleration data that are registered by the acceleration sensor until an image-based current position is again determined and the current position is recalibrated. A so-called "drifting" of the calculated current position from the image-based current position is thereby counteracted. Advantageous in such an embodiment is that, for recalibration, unlike in methods and systems of the prior art, in which an uppermost and/or a lowermost story must be traveled to, the calibration can take place over the entire elevator hoistway at any time, for example during a travel.

Preferably, in a specified, or specifiable, first time interval, recorded images of the elevator hoistway are recorded by the image-recording unit. Two consecutively recorded images are compared by the computing unit in order to detect a spatial displacement of the two images, reference to the acceleration data to determine the position and/or velocity of the elevator being made only if a spatial displacement has been detected by the computing unit based on the images that have been recorded. However, the images that are compared by the computing unit need not necessarily be recorded immediately consecutively.

It is evident that, in order to increase the reliability of the method, with the aid of the image-recording unit it is optically determined whether the elevator car has moved, i.e. has traveled a distance in the elevator hoistway. Only in this case is reference made to the acceleration to calculate the current position. Interferences by vibrations, such as arise, for example, when loading and unloading an elevator car, and are registered by the acceleration sensor, can thus be excluded.

Preferably, images are only recorded when the acceleration sensor registers acceleration data of the elevator cars. Hereby, it is ensured that the computer unit need not constantly compare images from the image-recording unit, but a comparison only takes place in the case of detection of an acceleration (and therefore a possible movement) by the acceleration sensor.

Preferably, acceleration data are recorded with a frequency of 100 Hz.

Preferably, images are recorded with a frequency of 60 Hz.

Preferably, images are only recorded when the acceleration data lie above a specified, or specifiable, threshold value.

This ensures that accelerations that are measured by the acceleration sensor during, for example, loading and unloading of the elevator car, do not trigger the image-recording unit. It is therefore possible to use a relatively inexpensive and simple computing unit, since this need not continuously process and, if necessary, store, recorded images.

Preferably, acceleration data that lie above a specified, or specifiable, threshold value are rejected by the computing unit.

Also underlying this preferred embodiment is the idea of restricting the computing capacity of the computing unit to a minimum. In addition, by this means, acceleration data that lie above the second threshold value, and which are known from experience to be caused by faults, are disregarded. For example, accelerations greater than 1 g, which occur during an emergency braking of the elevator car, can be excluded, since in this case it is ensured by an emergency-brake arrangement that the elevator car comes to a standstill.

Particularly preferably, a recalibration of the current position takes place when a deviation between the image-based current position and the calculated current position lies above a specified, or specifiable, threshold value. In this case, the image-based current position, which has been determined directly and definitively, is put in the place of the calculated current position (which has been determined indirectly from the acceleration data).

Alternatively, the recalibration of the current position can take place with the image-based current position in a second time interval. In this alternative, upon every comparison of the recorded images with the mapping images, in which an image-based current position is determined, the current position is recalibrated. This recalibration hence takes place continually at second time intervals.

Preferably, the image-based current position is determined with images that are recorded in a specified, or specifiable, second time interval, the second time interval being greater than, or equal to, the first time interval. Also in this case, a reduction of the computing time is attained. This is because not all of the images that are recorded by the image-recording unit are used for determination of the image-based current position and, therefore, the computing effort of the computing unit is reduced. Particularly preferably, the second time interval lies in the range between 500 and 100 ms, which corresponds to a frequency of 2 to 10 Hz.

Preferably, the mapping images from the learning travel of the elevator car are saved in a database. This database is connected to the computing unit. A storage address of a mapping image in the database is defined, which depends on the position along the elevator hoistway. The computing unit uses the calculated current position to narrow down a search for a mapping image in the database.

Hence, when comparing the recorded images with the mapping images to determine an image-based current position, the mapping image that is matched with the recorded image can be found in the database more rapidly. The advantage that results therefrom is even twofold, since a mapping image can not only be found more quickly, but the computing capacity of the computing unit can also be further reduced.

The invention further relates to a system for determining the position of an elevator car of an elevator system that is arranged capable of travel in an elevator hoistway. Such a system can preferably be operated with one of the aforesaid methods. It is therefore evident that the aforesaid advantages regarding the method according to the invention also apply for the system according to the invention.

The elevator car is equipped with an acceleration sensor. The system further contains a computing unit, which is so embodied as to register acceleration data from the acceleration sensor and to calculate a current position and/or velocity of the elevator car based on a starting position and the registered acceleration data.

According to the invention, the system further contains an image-recording unit, which is embodied for the purpose of recording images of the elevator hoistway and transmitting them to the computing unit. The computing unit is further embodied for the purpose of comparing recorded images with mapping images of the elevator hoistway, so as to determine an image-based current position and a recalibration of the current position by making use of the image-based current position.

Preferably, the image-recording unit is further embodied so as to, in a specified, or specifiable, first time interval, record recorded images of the elevator hoistway and transmit them to the computing unit. The computing unit is further embodied so as to compare two consecutively recorded images with each other in order to detect a spatial displacement of the two images and only to refer to the acceleration data to determine the position and velocity of the elevator car when a spatial displacement is detected by the computing unit.

Preferably, the computing unit is so embodied as to control and/or regulate the recording of images by the image-recording unit when acceleration data of the elevator car are registered.

Preferably, the computing unit is so embodied as to only register acceleration data when they lie above a specified, or specifiable, threshold value. Further preferably, the computing unit is so embodied as to reject acceleration data that lie above a specified, or specifiable, second threshold value.

Further preferably, the computing unit is so embodied that, when a deviation between the current image-based position and the current position lies above a specified, or specifiable, threshold value, the current calculated position is recalibrated with the current image-based position. Alternatively thereto, the computing unit is so embodied that, in a second time interval, the current position is recalibrated with the image-based current position.

Further preferably, the computing unit is so embodied that the image-based current position is determined with images that are recorded in a specified, or specifiable, second time interval, the second time interval being greater than, or equal to, the first time interval.

Preferably, a database is provided, which is so embodied as to store mapping images that were generated in a learning travel of the elevator car. Therein, a storage address of a mapping image in the database is defined that depends on the position along the elevator hoistway. Further, the computing unit is so embodied as to narrow down a search for a mapping image in the database by making use of the calculated current position.

The invention further relates to an elevator system that is equipped with an aforesaid system for determining the position of the elevator car.

The advantages of the method and system are apparent from the foregoing description.

DESCRIPTION OF THE DRAWINGS

The invention is explained below in exemplary form by reference to an exemplary embodiment in association with the figures. Shown are in.

DETAILED DESCRIPTION

Figure 1:
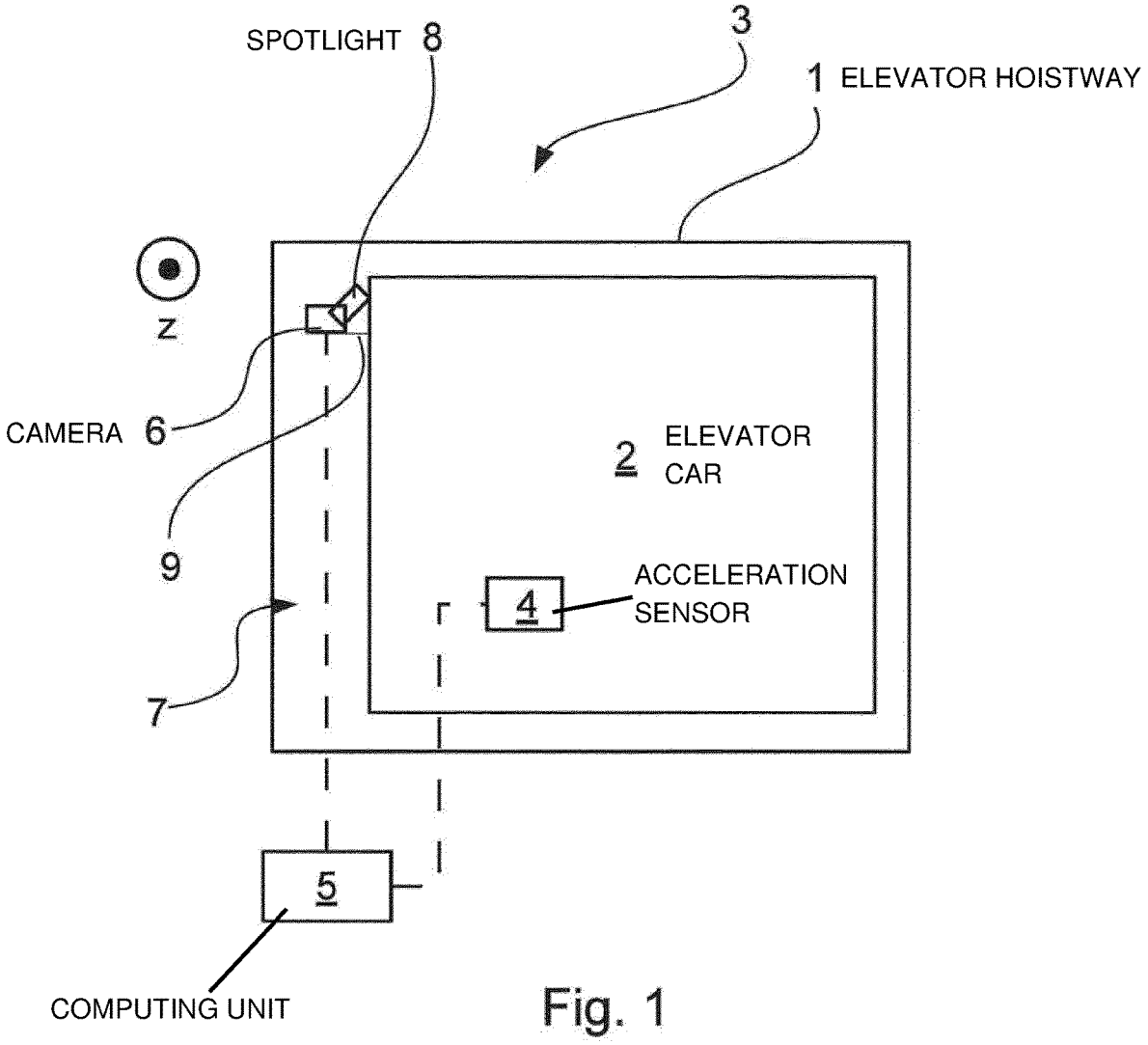
FIG. 1 is a schematic cross-sectional view of an exemplary embodiment of an elevator system with a system for determination of the position according to the invention.

Shown in FIG. 1 is an elevator system 3, which is equipped with a system 7 for determining the position according to the invention. The elevator system 3 comprises an elevator car 2, which is arranged in an elevator hoistway 1 capable of travel along an axis z. Not shown are any suspension and traction means that are used for the suspension and movement of the elevator car 2.

The elevator car 2 is further provided with an acceleration sensor 4, which is connected with a computing unit 5. The connection between the acceleration sensor 4 and the computing unit 5 is represented schematically with a dashed line. The connection can take the form of a direct connection via cable, for example with a bus system, or of a wireless connection. In the exemplary embodiment that is shown in FIG. 1, the computing unit 5 is situated on the elevator car 2. However, the computing unit 5 need not necessarily be situated in the elevator hoistway 1.

The acceleration sensor 4 measures the accelerations Dg that occur in the elevator car 4 and transmits them to the computing unit 5. Of particular importance are the accelerations that occur in the z direction, which can indicate a movement of the elevator car 2, and must therefore be reliably registered.

The elevator car is further equipped with a camera 6, here exemplarily a CCD camera, which, by means of an arm 9, is mounted on the elevator car 2. The arm 9 allows adjustment of the alignment of the camera 6 and also allows retrofitting of already existing elevator systems.

The camera 6 is also, as indicated schematically by the dashed line, connected with the computing unit 5. For illumination of the elevator hoistway 1, a spotlight 8, for example a LED spotlight, is arranged on the arm 9. The camera 6 can thus record a sufficiently illuminated area of the elevator hoistway 1, which improves the quality of the recorded images and hence increases the reliability of the image-comparison.

Figure 2:
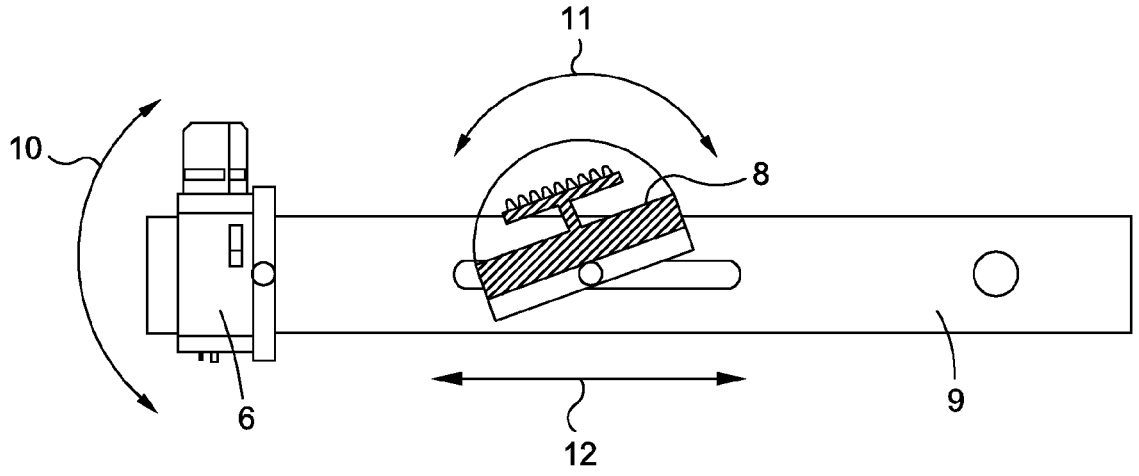
FIG. 2 is a detailed view of an exemplary embodiment of the arm of FIG. 1.

Shown in FIG. 2 is an exemplary embodiment of the arm 9. For the purpose of adjustment, the camera 6 can be swiveled about a swivel axis, as indicated by the double arrow 10. In addition, the spotlight 8 can be both swiveled around a swivel axis 11 and displaced along the arm 9, as indicated by the double arrows 11 and 12 respectively.

Figure 3:
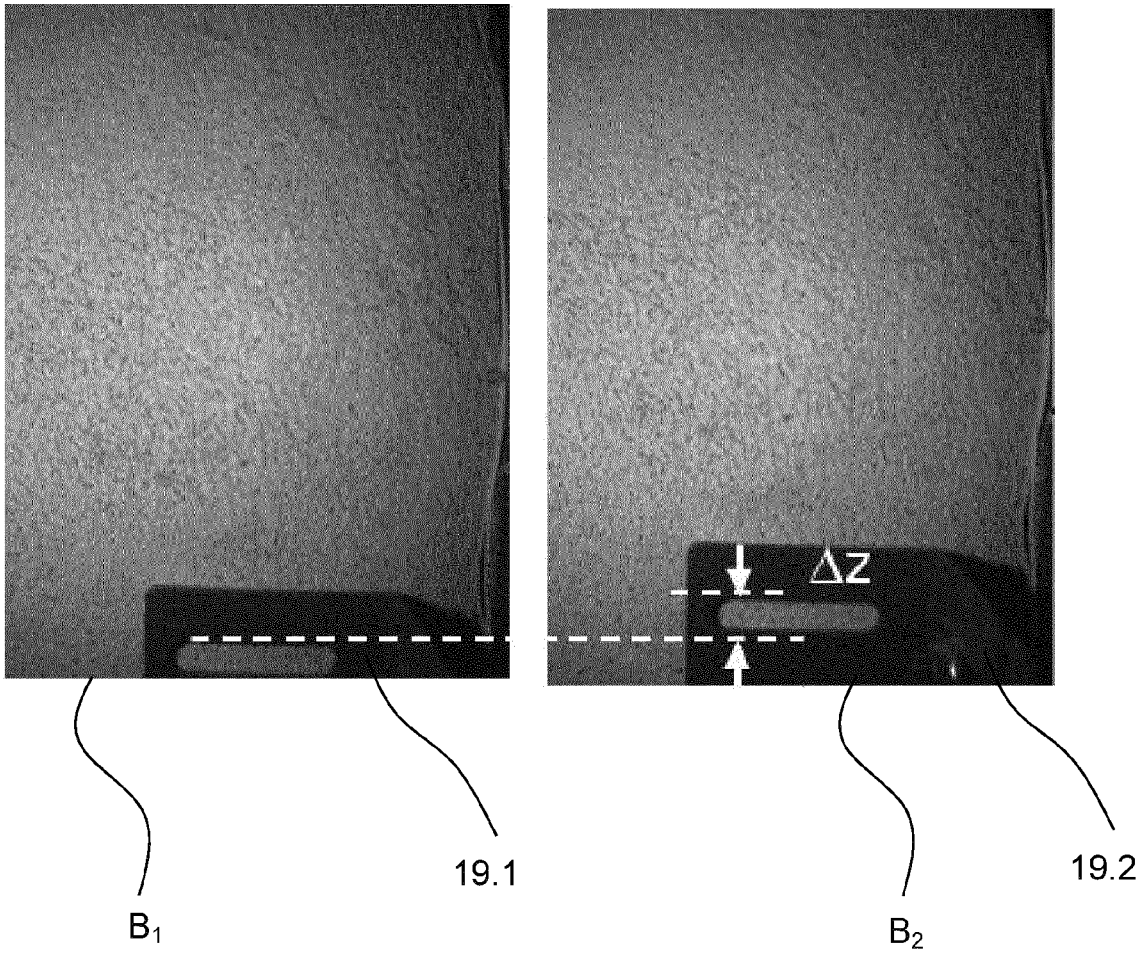
FIG. 3 is an exemplary image-comparison of two consecutively recorded images in a first specifiable time interval.

The camera 6 is operated at a recording rate of 60 Hz. Through a comparison of two consecutively recorded images B1 and B2, it can be determined whether a displacement Δz of the images in the z direction has taken place. In FIG. 3, such a displacement Δz between two consecutively recorded images B1 and B2 is illustrated. In particular, FIG. 3 shows exemplarily a displacement Δz relative to a fastening element 19.1, 19.2. The fastening element 19.1 appears in the lower area of the first image B1. In the second image B2, the fastening element 19.2 appears higher by the displacement Δz. The displacement Δz that is detected in the images B1 and B2 therefore corresponds to a downward travel by the elevator car 2 of Δz. This comparison preferably takes place based on a grey-value comparison of the two images B1 and B2. It can therefore be determined whether the elevator car has been moved in the z direction. These optically determined data are used to complement the data from the acceleration sensor 4.

By reference to the acceleration sensor 4, it can be determined whether the elevator car 2 experiences an acceleration Dg. From it, a position zt of the elevator car 2 can be derived. However, a movement with constant velocity will not be registered by the acceleration sensor 4, since, in this case, the measured acceleration of the elevator car is zero. However, through the optical movement-detection, standstill and movement of the elevator car 2 can be differentiated. Consequently, the (inertia-based) position-determination based on the data from the acceleration sensor 4 is only used when a movement of the elevator car 2 is optically detected.

Figure 4:
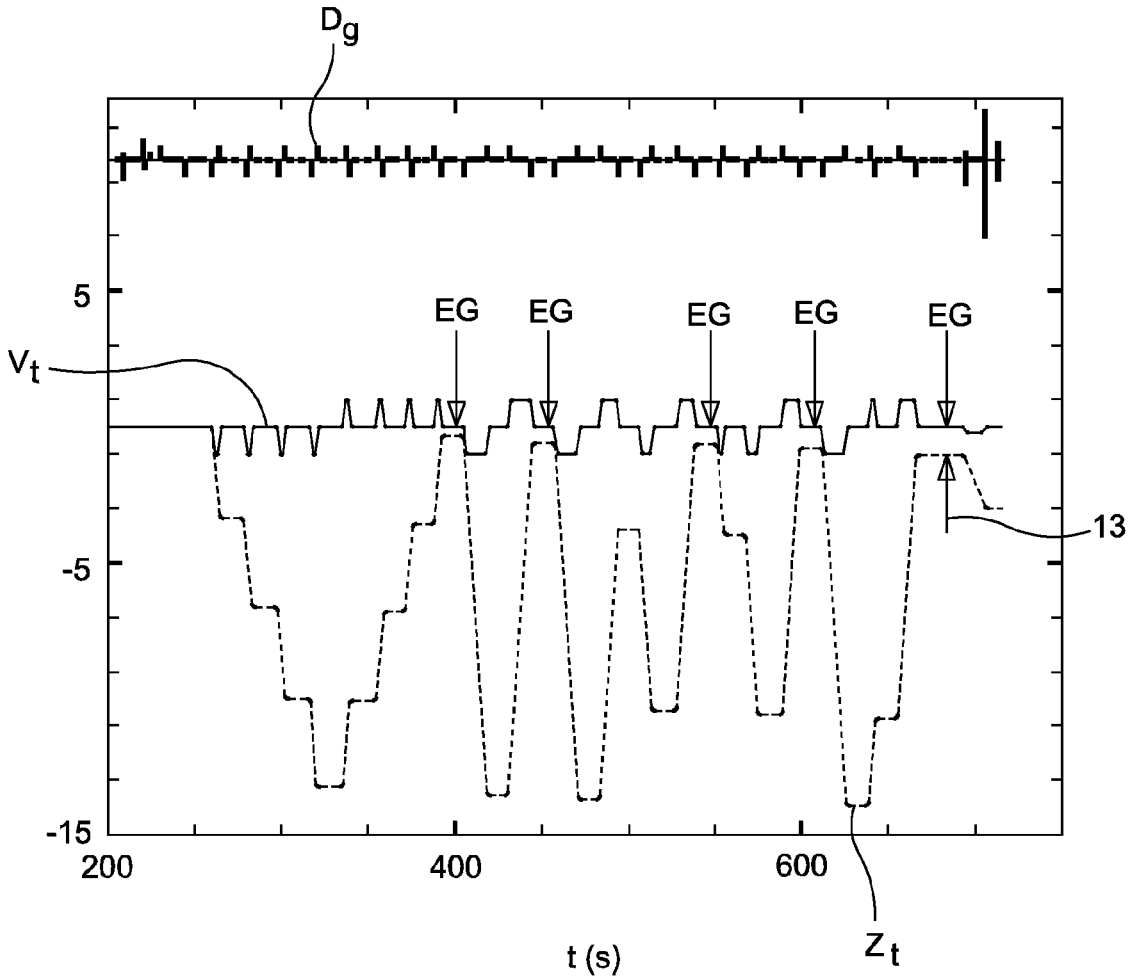
FIG. 4 is a graphical representation of exemplary acceleration data, and the position and velocity of the elevator car calculated therefrom.

Shown in FIG. 4 are the data that are registered by the acceleration sensor 4. Represented by Dg is a plot of the acceleration of the elevator car 2 measured by the acceleration sensor 4. When the car is stationary, the acceleration measured by the acceleration sensor 4 is 9.81 m/s2. Through integration of the acceleration Dg, the velocity vt and the inertia-based position zt can be calculated, which are also represented in FIG. 4 in m/s and m respectively. In the case that is illustrated in FIG. 4, the elevator car 2, as indicated by the arrows EG, is regularly halted at a stop z=0 m. It can, however, be seen that, after a first travel, the inertia-based position zt, which is calculated from the acceleration data Dg, never assumes the value of 0 m but steadily diverges from this value. At a time of 670 s, this divergence, referred to as "drift", amounts to as much as approximately 1 m, as indicated by the arrow 13.

Further, to determine the current position of the elevator car, images that were recorded at a time interval of 100 to 200 ms are compared with mapping images from a database. The mapping images from the database were recorded during a learning travel, for example during commissioning of the elevator system 3, and assigned definitively to a position of the elevator car 2 in the elevator hoistway 1. Thus, it is possible to determine the position zBt of the elevator car 2 by reference to a direct, image-based measurement and not, as usual hitherto, by means of indirect methods.

Particularly advantageously, when determining an image-based current position zBt, in which a recorded image is compared with mapping images, the computing unit searches the database for a matching mapping image with the aid of a calculated current position zt. The search in the database can thereby be greatly narrowed down, since the storage addresses of the mapping images are defined depending on the position along the elevator hoistway 1.

In particular, through a thermally caused expansion or contraction, or a gravity-induced settlement, of a building, the accuracy of indirect methods, as for example an incremental disk or a magnetic-tape coding, diminishes. The system 7 is not affected by such a diminution of the accuracy, since the optically determined, image-based position zBt is independent of the aforesaid interference factors.

The current image-based position zBt, which, as described above, has been optically determined, is further used to correct the position zt, which was calculated by means of acceleration data from the acceleration sensor 4.

For this purpose, the optically determined, image-based position zBt is compared with the inertia-based position zt, which was calculated from the acceleration data of the acceleration sensor 4, and which is subject to "drifting". If the deviation between the optically determined, image-based position zBt and the calculated, inertia-based position zt is too large, a recalibration of the position takes place. In the recalibration, the optically determined, image-based position zBt is set as the current position. Starting therefrom, the acceleration data from the acceleration sensor 4, as described above, are used to further determine the position zt of the elevator car 2. The use of further systems for position determination, as for example an incremental disk or a magnet coding, can thereby be obviated. Such a recalibration is also possible at any time and not, as usual hitherto, only at the uppermost or lowermost stop of an elevator car 2.

As stated at the outset, alternatively, the recalibration of the current position zt can take place at time intervals t2 of between 100 and 200 ms at each comparison of a recorded image with mapping images in which an image-based current position is determined.

Figure 5:
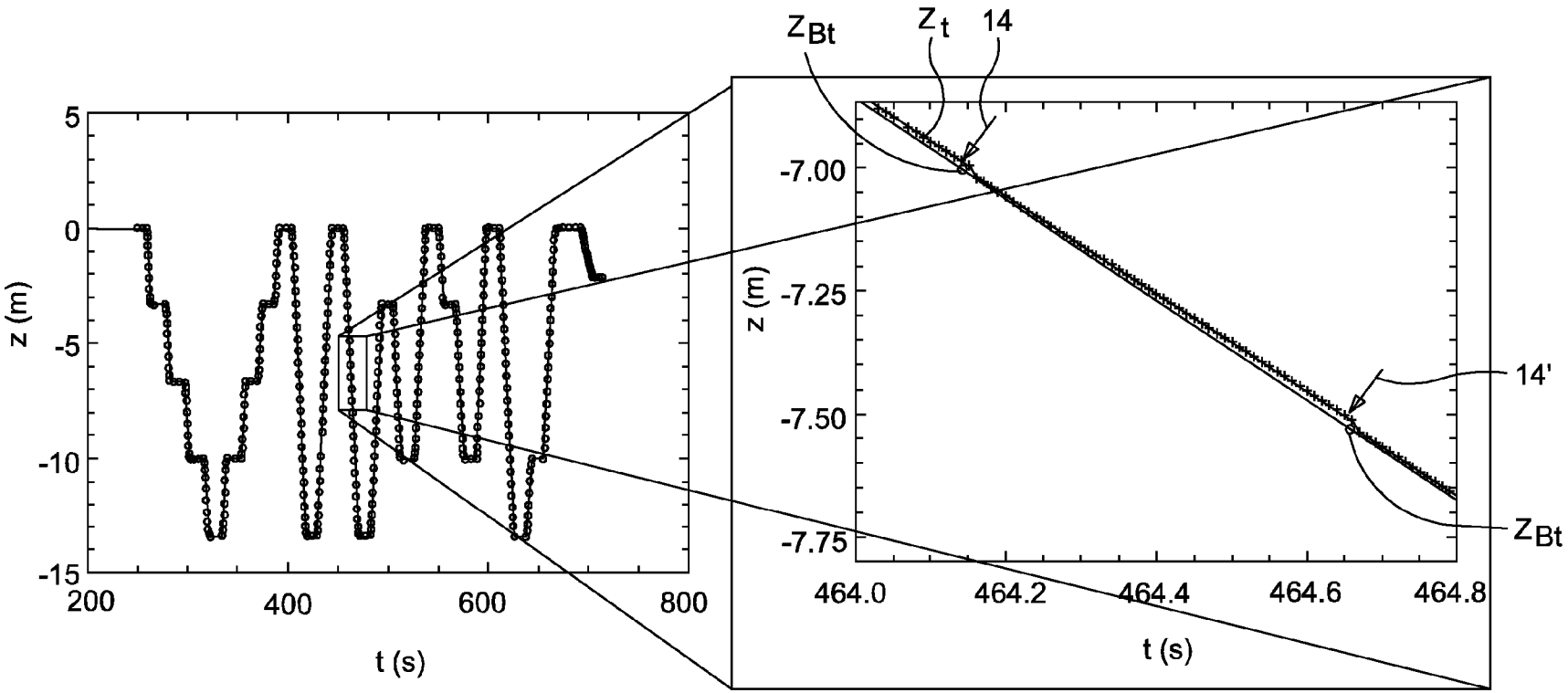
FIG. 5 is a graphical representation of the calculated and image-based positions.

In FIG. 5, the process of such a recalibration is illustrated, the right-hand diagram being an enlargement of the framed area of the left-hand diagram. Therefrom it can be seen that, over time, the calculated, inertia-based position zt deviates from the optically determined, image-based position zBt. If the deviation lies above a threshold value, the calculated, inertia-based position zt is recalibrated by the optically determined, image-based position zBt being set as the current position of the inertia-based positioning system, as indicated by the arrow 14. As described above, the position-determination then continues until the deviation between the optically determined, image-based position zBt and the calculated, inertia-based position zt again attains the threshold value and a new recalibration takes place, as indicated by the arrow 14'.

Figure 6:
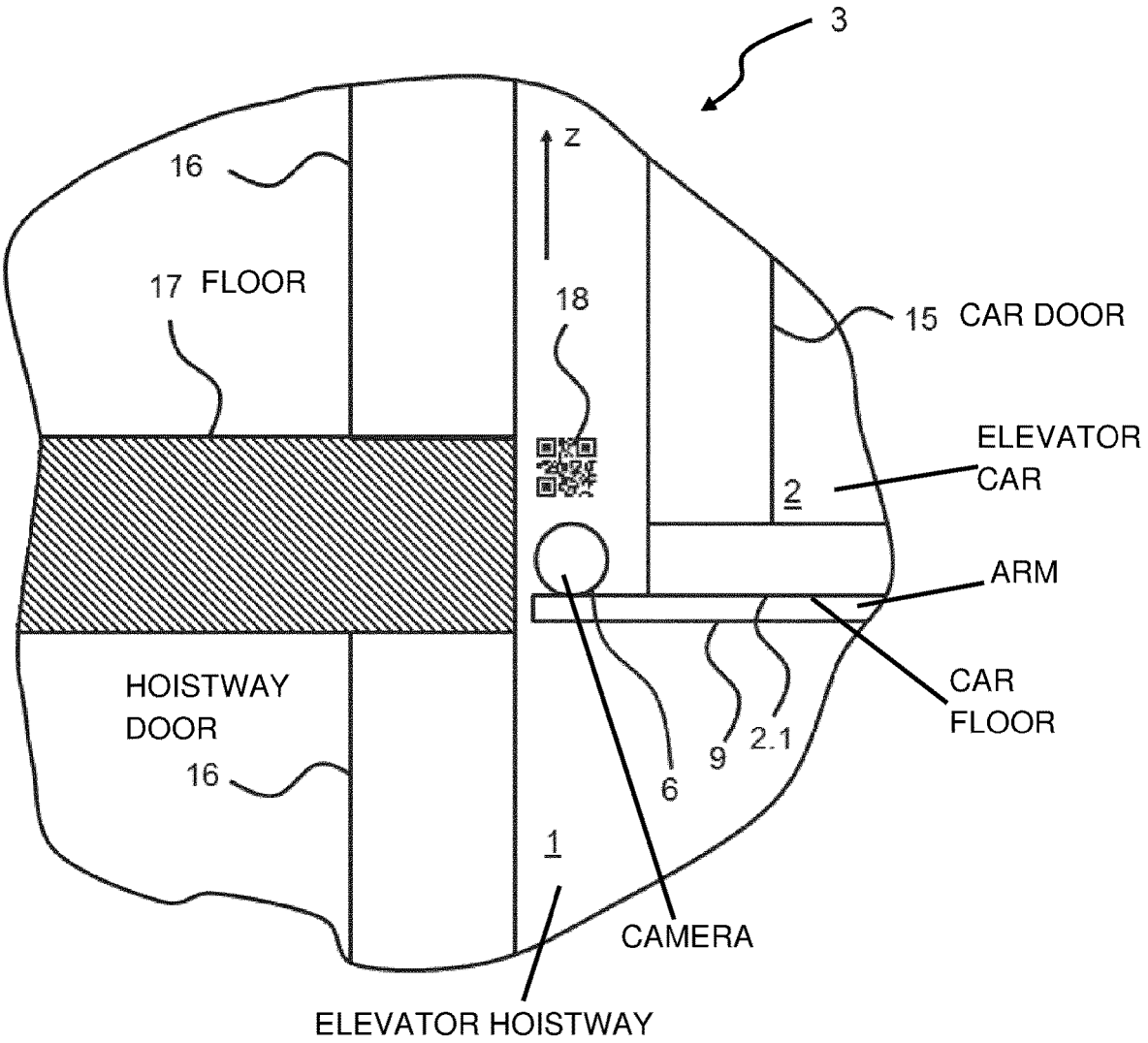
FIG. 6 is an exemplary QR code, which serves to indicate a floor position.

FIG. 6 shows schematically a detail of the elevator system 3 at a floor 17, FIG. 6 showing a situation in which the elevator car 2, in vertical travel in direction z in the hoistway 1, is about to arrive at the floor 17. The hoistway 1 can be closed off from the floor 17 by a hoistway door 16. Provided on the side of the elevator car 2 that faces the hoistway door 16 is a car door 15. The floor 17 is marked with a floor-marking 18, here exemplarily embodied as a QR code, which lies in the vision range of the camera 6 and by which it can be recorded. The camera 6 is mounted on the arm 9, which is fastened, for example, to the car floor 2.1 of the elevator car 2. The floor-marking 18 is preferably characteristic for each floor 17, so that, based on the floor-markings 18, which are recordable by the camera 6, an automatic recognition of the floor positions of all floors 17 along the hoistway 1 is possible.

The hoistway floor-markings 18 that are recognized pictorially by the camera 6 are also, in a learning travel, recordable as mapping images KB and are correspondingly stored in the database. The images that are recorded in the area of the floor-markings 18 are especially easily assignable to a mapping image KB, so that a calibration of the calculated current position zt in the area of the hoistway floor-markings 18 is particularly robust. In a time-limited failure of the system 7, the floor-markings 18 can therefore serve as fallback point, or starting position, z0, for recalculation of the current position zt.

Tests by the applicant have demonstrated that the dimensioning of the QR code 18 is important for the faultless recognition of the story floor positions. The QR code 18 preferably has a dimension of at least 3 cm×3 cm, an optimal range of the dimension lying between 4 cm×4 cm and 6 cm×6 cm. With even larger QR codes, recognition is also assured, but only with a correspondingly large vision range of the camera 6.

It is evident that such a system 7 for determining the position of an elevator car 2 can easily be retrofitted to existing elevator systems 3. To do so, the camera 6 and, if present, the spotlight 8 need only be fastened to the elevator car and connected with the computing unit 5. Advantageous is for the computing unit 5 to consist of the already-existing regulating and/or control unit of the elevator system 3, which is upgraded by software update or the addition of a hardware module. Optionally, floor-markings 18 can also be situated in the hoistway 1 at the floors 17. Subsequently, a learning travel takes place, in which the mapping images of the elevator hoistway 1 are recorded and assigned to a position of the elevator car 2.

Such a system 7 enables a very accurate position-determination with errors of less than 0.5 mm at elevator velocities of up to 5 m/s.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for determining a position of an elevator car of an elevator system, which elevator car is arranged for travel in an elevator hoistway, wherein the elevator car is fitted with an acceleration sensor, comprising the following steps:

registration of acceleration data generated by the acceleration sensor in a computing unit;

calculation by the computing unit of at least one of a current position and a velocity of the elevator car based on a starting position and the registered acceleration data;

providing the elevator system with an image-recording unit;

recording with the image-recording unit recorded images of the elevator hoistway;

comparing with the computing unit the recorded images with mapping images of the elevator hoistway to determine an image-based current position of the elevator car; and operating the computing unit to undertake a recalibration of the current position of the elevator car using the image-based current position of the elevator car;

wherein to determine the current position or the velocity of the elevator car, either reference is made to the acceleration data only when a spatial displacement has been detected by the computing unit or recording the recorded images is only done when the acceleration sensor generates the acceleration data of the elevator car.

2. The method according to claim 1 including, in a specified time interval, recording the recorded images of the elevator hoistway by the image-recording unit, and comparing two consecutively recorded ones of the recorded images from the specified time interval to detect by the computing unit a spatial displacement of the two images.

3. The method according to claim 2 including at least one of recording the recorded images only when the acceleration data lie above a predetermined first threshold value and rejecting the acceleration data that lie above a second threshold value by the computing unit.

4. The method according to claim 1 including performing a recalibration of the current position of the elevator car with the image-based current position in a specified time interval, or, when a deviation between the image-based current position and the current position lies above a specified threshold value, performing a recalibration of the current position with the image-based current position.

5. The method according to claim 1 including determining the image-based current position with images that are recorded in a specified first time interval, the determining being performed in a specified second time interval that is greater than, or equal to, the first time interval.

6. The method according to claim 1 including saving the mapping images in a database during a learning travel of the elevator car, wherein a storage address of each of the mapping images in the database is defined depending on an associated position of the elevator car along the elevator hoistway, and in that the current position of the elevator car is used by the computing unit to narrow down a search for the associated mapping image in the database.

7. A system for determining a position of an elevator car of an elevator system, which elevator car is arranged for travel in an elevator hoistway, wherein the elevator car is equipped with an acceleration sensor, and including a computing unit for registering acceleration data from the acceleration sensor and, based on a starting position of the elevator car and the registered acceleration data, for calculating at least one of a current position and a velocity of the elevator car, comprising:

an image-recording unit for recording recorded images of the elevator hoistway and transmitting the recorded images to the computing unit; and wherein the computing unit compares the recorded images with mapping images of the elevator hoistway to determine an image-based current position of the elevator car and performs a recalibration of the current position using the image-based current position;

wherein, for the purpose of determining the current position or the velocity of the elevator car, either the computing unit refers to the registered acceleration data only when a spatial displacement is determined by the computing unit or the computing unit controls the image-recording unit to record images only when the acceleration data of the elevator car are registered.

8. The system according to claim 7 wherein the image-recording unit records the recorded images in a specified first time interval, and the computing unit compares two consecutively recorded ones of the recorded images from the first time interval to detect the spatial displacement of the two consecutively recorded images.

9. The system according to claim 7 including at least one of the computing unit registers the acceleration data only when the acceleration data lie above a specified first threshold value, and the computing unit rejects the acceleration data that lie above a specified second threshold value.

10. The system according to claim 7 including at least one of the computing unit, in a specified time interval, recalibrates the current position of the elevator car with the image-based current position, and the computing unit recalibrates the current position of the elevator car with the image-based current position when a deviation between the image-based current position and the current position lies above a specified threshold value.

11. The system according to claim 7 wherein the computing unit determines the image-based current position with images that are recorded in a specified first time interval, the determining being performed in a specified second time interval that is greater than, or equal to, the first time interval.

12. The system according to claim 7 including a database for storing mapping images generated in a learning travel of the elevator car, wherein a storage address of each of the mapping images is defined in the database depending on an associated position along the elevator hoistway, and the computing unit narrows down a search for one of the mapping images in the database by using the current position.

13. An elevator system including the system for determining the position of the elevator car according to claim 7.

* * * * *